United States Patent [19]

Carnavos et al.

[11] 4,402,359

[45] Sep. 6, 1983

[54] HEAT TRANSFER DEVICE HAVING AN AUGMENTED WALL SURFACE

[75] Inventors: Theodore C. Carnavos, Bethel; Walter J. Golymbieski, Woodbury, both of Conn.

[73] Assignee: Noranda Mines Limited, Toronto, Canada

[21] Appl. No.: 187,413

[22] Filed: Sep. 15, 1980

[51] Int. Cl.[3] ..... F28F 1/10

[52] U.S. Cl. ..... 165/70; 165/133; 165/179; 138/38; 138/121; 138/172

[58] Field of Search ..... 165/70, 179, 183, 133; 159/13 A, 13 R; 138/38, 121, 172, 133

[56] References Cited

U.S. PATENT DOCUMENTS

| | | | |
|---|---|---|---|
| 3,768,291 | 10/1973 | Rieger | 165/133 X |
| 3,830,290 | 8/1974 | Thamasett et al. | 165/70 |
| 3,861,462 | 1/1975 | McLain | 165/179 |
| 3,906,605 | 9/1975 | McLain | 165/179 |
| 4,044,797 | 8/1977 | Fujie et al. | 165/179 |
| 4,118,944 | 10/1978 | Lord et al. | 165/179 |

FOREIGN PATENT DOCUMENTS

| | | | |
|---|---|---|---|
| 680474 | 2/1964 | Canada | 73/40 |

*Primary Examiner*—William R. Cline
*Assistant Examiner*—Theophil W. Streule, Jr.
*Attorney, Agent, or Firm*—Fleit, Jacobson & Cohn

[57] ABSTRACT

A heat transfer device having an augmented surface is disclosed. The device comprises a base wall of heat conductive material having a plurality of pyramid-fins formed integrally with the surface of the base wall. The pyramid-fins are regularly spaced apart in the range of about 80–500 pyramid-fins per square inch and have a height in the range of 0.015 to 0.040 inch. The base wall is preferably a cylindrical tube and the pyramid-fins are formed as a knurled diamond pattern around the outside periphery of the tube.

9 Claims, 5 Drawing Figures

HEAT TRANSFER DEVICE HAVING AN AUGMENTED WALL SURFACE

This invention relates to heat transfer devices, and more particularly to a heat transfer tube having an enhanced or augmented wall surface.

It is known in the art to modify plain surfaces such as cylindrical tubes by scoring, finnng, knurling or roughening to increase the heat transfer capabilities of such surfaces. It is also known to enhance or augment both the inner and outer surfaces of heat transfer tubes to improve the heat transfer coefficient of such tubes. A representative example of such tubes is the one disclosed in U.S. Pat. No. 3,768,291 which issued on Oct. 30, 1973. These augmented tubes achieve over 100% heat transfer gains with respect to smooth tubes.

Applicant has surprisingly found that significantly higher heat transfer gains may be obtained by formng a heat enhancement pattern on a smooth surface so as to integrally form with the surface a plurality of pyramid-fins of predetermined density and height.

The heat transfer device, in accordance with the invention, comprises a base wall of heat conductive material and a plurality of pyramid-fins formed integrally with the surface of such base wall. The pyramid-fins are regularly spaced in the range of about 80–500 pyramid-fins per square inch and have a height in the range of 0.015 in (corresponding to a pyramid-fin density of 500 pyramid-fins per square inch) to 0.040 in (corresponding to a pyramid-fin density of 80 pyramid-fins per square inch). The pyramid-fins are preferably formed as a knurled diamond pattern by a knurling tool forming two series of parallel threads in the range of 12 to 30 threads per inch (TPI) intersecting each other at an angle of about 60°. Optimum heat exchange enhancement has been obtained using a knurled diamond pattern of 20 TPI and a pyramid-fin height of 0.022 in.

The base wall is usually a tube. The heat transfer enhancement pattern may extend through the thickness of the tube wall so as to form a doubly augmented tube and so increase heat transfer without doing any special work on the inside wall of the tube. Alternatively, integral fins may be formed on the inside of the tube to obtain a doubly augmented tube and so increase heat transfer further. The helix angle of the internal fins is between 0° and 90°, preferably in the range of 15°–45° with respect to the longitudinal axis of the tube.

The above tube with the pyramid-fins formed on the outside surface only may be provided with a visible leak detector by tightly mounting an inner tube within the augmented tube so as to form an assembly consisting of an inner and an outer tube. The inner or outer tube is provided with longitudinally extending grooves forming leak detector passages between the outer and inner tubes. The inner tube may have integral internal fins so as to form a doubly augmented tube assembly with leak detection.

The invention will now be disclosed, by way of example, with reference to the accompanying drawings in which.

Figure 1:
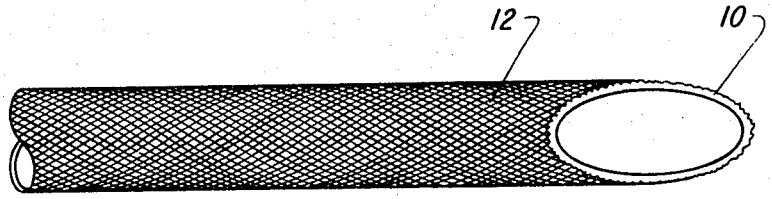
FIG. 1 is a perspective view of an augmented tube in accordance with the invention.

Referring to FIG. 1, there is shown a heat transfer tube 10 having a plurality of integral radially extending pyramid-fins 12 formed in its outer surface. The density of the pyramid-fins is between 80 and 500 pyramid-fins per square inch and the height of the pyramid-fins is between 0.015 inch for a pyramid-fin density of 500 pyramid-fins per square inch and 0.040 inch for a pyramid-fin density of 80 pyramid-fins per square inch. The pyramid-fins are made by a knurling tool forming two series of threads intersecting each other at 60° so as to form a herringbone or diamond pattern. The threads are in the range of 12 to 30 TPI, preferably about 20 TPI. The height of the pyramid-fins formed is between about 0.037 in at 12 TPI and about 0.015 in at 30 TPI. The preferred height of the pyramid-fins is about 0.022 in at 20 TPI.

Figure 2:
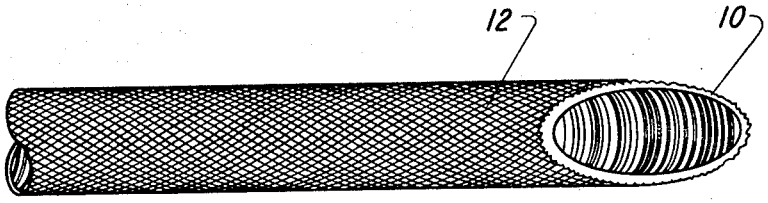
FIG. 2 is an alternative of the augmented tube shown in FIG. 1.
Figure 3:
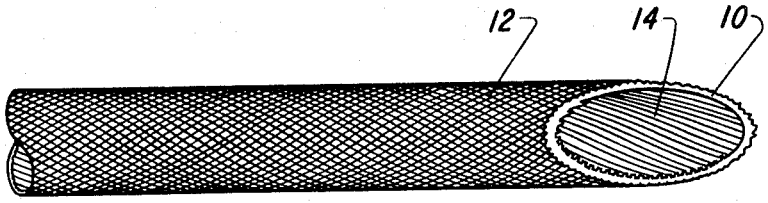
FIG. 3 is another alternative of the augmented tube shown in FIG. 1.

When the pyramid-fins are formed on a tube of relatively small thickness, the heat transfer enhancement pattern will extend through the thickness of the tube wall as shown in FIG. 2 so as to form a doubly augmented tube. If the tube wall is thick enough, or if a smooth mandrel is placed inside the tube during formation of the external heat transfer enhancement pattern, then the inside of the tube will remain smooth. The inside of the tube may then be provided with internal fins 14 such as shown in FIG. 3 of the drawings. These fins may be formed prior to making the outside pyramid-fins or at the same time by pressing the tube during knurling onto a mandrel placed inside the tube and having suitable grooves for forming the fins. The helix angle of the internal fins is between 0° and 90°, preferably between 15° and 45° with respect to the longitudinal axis of the tube.

Figure 4:
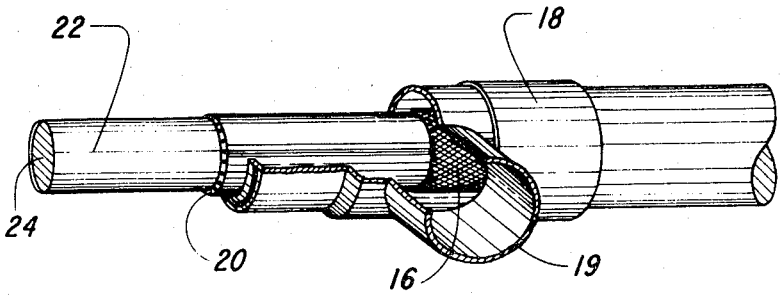
FIG. 4 is a perspective view of a heat exchanger including an augmented tube in accordance with the invention and also incorporating a leak detector.

Referring to FIG. 4, there is shown a heat exchanger incorporating a leak detector such as disclosed in Canadian Pat. No. 680474 issued Feb. 18, 1964. The heat transfer tube 16 is located within an outside shell 18 which is provided with an inlet 19 for circulating fluid in the annulus formed between the outer surface of tube 16 and the inside surface of shell 18. The heat transfer tube 16 is provided with longitudinally extending inside grooves 20 and a heat transfer tube 22 having a smooth outer surface is fitted tightly inside tube 16. Tube 22 terminates outside the tube 16 and is used for feeding fluid in the heat exchanger, preferably counterflow to the fluid circulated within the annulus formed by the shell 18. The grooves 20 form leak detector passages in case one or both tubes 16 or 22 develop a leak. The inside of tube 22 may be provided with fins 24 as disclosed previously in connection with the description of tube 10 in order to increase heat transfer between the fluid flowing inside shell 18 and the fluid flowing inside tube 22.

Heat transfer tests were performed on six tubes hereinafter designated C-0 through C-5 with turbulent water flow in both sides of the tube wall. The tubes include a tube C-0 having smooth internal and external surfaces, a tube C-1 having a smooth external surface and internal fins similar to the ones shown in FIG. 3, and four tubes C-2, C-3, C-4 and C-5 having pyramid-fins such as shown in FIG. 1 of incremental density and decreasing height formed on their external surfaces, and internal fins identical to tube C-1. The nominal dimensions of the six tubes were the same and the external augmentation as obtained from integral type knurled surfaces was the primary variable explored. The purpose of the test program was to qualitatively determine the superior types of externally augmented surfaces.

The tubes tested were jacketed in a smooth shell forming an annulus inside which flowed hot water in counterflow to colder water on the tubeside. The hot water flowed in a closed circuit from a heater powered by a 9 kw powerstat to the test section, through a calibrated 250 mm rotameter, and returned for reheating. The cold water also flowed in a closed circuit from its tank through a calibrated 600 mm rotameter, then tubeside of the test section, and returned to tank. A heat exchanger connected to the water supply and tank cooled the tubeside water in a separate loop. All material in the flow circuits contacting the test section were nonferrous. The apparatus was well insulated. Operating temperature range was 115° F. maximum to 65° F. minimum. Temperature measurements were made with 450 mm precision mercury in glass-stem thermometers having 76 mm immersions and 0.1° F. minimum graduations. The thermometers were immersed to the required depth via copper tube thermowells. Pressure difference measurements were obtained with either of two ITT-Barton differential pressure cells with ranges of 0–40 and 0–300 inches of water. Piezometric rings with four taps each were used to sense pressure and were located on the shell with the inlet ring 90 hydraulic diameters downstream of the last disturbance. Frictional length of the tubes was 3 ft.

The tubes tested were housed in a jacket shell forming an annulus with a 1.63:1 diameter ratio. The tubes themselves were 0.625" O.D.×0.575" I.D. nominal with a heated length of 4.75 ft. Internal augmentation was provided by 32 spiral fins that were 0.025" high and 0.12" thick. The fin spiral was 1 turn in 6" for a helix angle of 16.75 degrees. Tubes C-2, C-3, C-4 and C-5 were knurled at 12 TPI×0.037" (height of pyramid-fins), 20 TPI×0.022", 30 TPI×0.015, and 40 TPI×0.011", respectively.

Testing was conducted under steady state conditions as determined from a gross temperature change not exceeding 0.3° F. over a ¾-hour span in each inlet water stream. Data to be acceptable had to generate heat balances with discrepancies no greater than ±5%. A minimum of two complete sets of readings constituted a run. Thermometer positions were alternated in the same water stream to average out thermometer errors. This technique was most important for runs with small delta T's. Heat balances were calculated from averaged readings and were well within the ±5%.

Since it was the purpose of the program to determine the superior type of externally augmented surfaces, the tubeside was operated at a constant mass flux of 6778 pounds per hour that resulted in a nominal velocity of 17.1 ft. per second. The tubeside resistance to heat transfer was thus minimized and overall performance was then a truer reflection of the external performance by itself. The annular velocity of the fluid was 6.1 ft. per second.

The data were reduced to performance parameters as follows:

U - Overall Heat Transfer Coefficient
$U=(Q/A\ \theta m)$ BTU/hf. sq. ft. °F.

where

Q=Heat Load - BTU/hr.

A=Nominal External Heat Transfer Area - sq. ft.
$\theta m$=Log Mean Temperature Difference - °F.
Re - Reynolds Number
$Re=(D\ G/u)$ Dimensionless D=Annular Characteristic Diameter (Di-Do) - ft.
G=Mass Velocity - lb. per hr. per sq. ft.
u=Viscosity - lb. per hr. ft.

In all cases, physical properties were evaluated at average bulk conditions and dimensions were based on nominal for the tube, i.e., as if there was no augmentation on either side of the tube wall.

Figure 5:
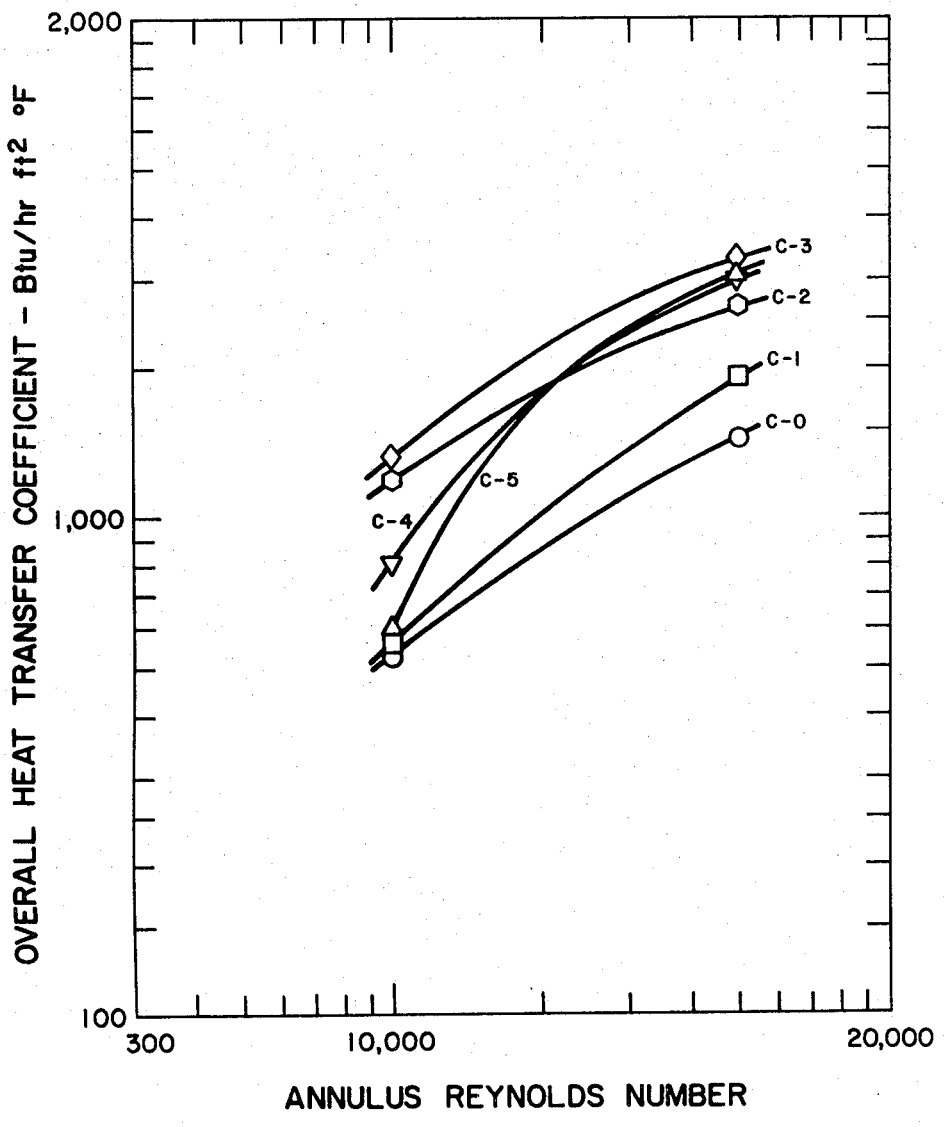
FIG. 5 illustrates the overall performance of augmented tubes with respect to a smooth tube.

FIG. 5 provides the graphical presentation of performance parameters for all the tubes tested. Over the Reynolds Number range of these tubes, tube C-3, the tube having the 20 TPI knurled surface, exhibited the highest overall heat transfer rate, some 100 to 150% above smooth tube C-0 across a broad Reynolds Number range. Tube C-2 with the heaviest knurled surface (12 TPI) exhibited a heat transfer rate lower than tube C-3. Tube C-4 with a lighter knurled surface (30 TPI) than C-3 exhibited a heat transfer rate lower than tube C-3, more particularly at lower Reynold Numbers. Tube C-5 with a lighter knurled surface (40 TPI) than C-4 exhibited a heat transfer rate even lower than C-4 at lower Reynold Numbers. In fact, the performance of tube C-5 at lower Reynold Numbers is not much better than a smooth tube. Thus, the performance of tube C-5 and to a smaller degree that of tube C-4 clearly indicates that the heat-transfer capabilities of the pyramid-finned tubes is deteriorating as the density of the pyramid-fins increases above and their height decreases below that formed by knurling at 30 TPI. Therefore, applicant believes that the knurled surface should be between 12 and 30 TPI preferably about 20 TPI, with the height of the pyramid-fins being respectively between 0.037" and 0.015", preferably about 0.022".

A comparison of Tube C-0 and C-1 shows that the portion of these heat transfer gains which is made possible by the presence of internal augmentation is about 10–30% for the specific tubeside configuration and operating conditions prevailing.

It is clearly seen from the above that the performance gains obtained with the augmented tubes having the above disclosed pyramid-fin density and height relative to smooth tube C-0 are very substantial. The use of such augmented tubes would therefore provide higher thermal efficiency for the same size heat exchanger or equal efficiency for a much smaller heat exchanger. The augmented tube applications include but are not limited to solar energy for heating of potable water, heat recovery systems, counterflow heat exchangers and other heat exchangers using fluids such as refrigerants (condensing and evaporating), and heat transfer oils.

We claim:

1. In a heat transfer device, a tube of heat conductive material having augmentation on the inner and outer surfaces thereof, the improvement comprising a plurality of pyramid-fins formed integrally with the outer surface of said tube, the pyramid-fins being regularly spaced apart in the range of about 12 to 30 threads per inch (TPI) and having a height which is related to the TPI and which height decreases in the range of about 0.040 to 0.015 inches, respectively, as the TPI increases, resulting in the pyramid-fin density increasing from about 80 to 500 pyramid-fins per square inch.

2. A heat transfer device as defined in claim 1, wherein said pyramid-fins are of a knurled diamond pattern having two series of parallel threads intersecting each other at about 60°.

3. A heat transfer device as defined in claim 2, wherein the two series of parallel threads of the knurled diamond pattern are at 20 TPI and the height of the pyramid-fins is about 0.022 inch.

4. A heat device as defined in claim 1, wherein the tube is provided with a heat transfer enhancement pattern extending through the thickness of the tube wall providing a doubly augmented tube.

5. A heat transfer device as defined in claim 1, wherein the tube has integral internal fins.

6. A heat transfer device as defined in claim 5, wherein the internal fins form a helix having a helix angle in the range of 15°–45° with respect to the longitudinal axis of the tube.

7. A heat transfer device as defined in claim 1, wherein an inner tube is mounted within such tube so as to form an outer and an inner tube, and wherein one of said tubes is provided with longitudinally extending passages forming leak detectors between said outer and inner tubes.

8. A heat transfer device as defined in claim 7, wherein said inner tube has integral internal fins so as to form a doubly augmented tube assembly with leak detection.

9. A heat transfer device as defined in claim 8, wherein the internal fins form a helix having a helix angle in the range of 15°–45° with respect to the longitudinal axis of the tube.

* * * * *